US009211986B2

(12) United States Patent
Auclair

(10) Patent No.: US 9,211,986 B2
(45) Date of Patent: Dec. 15, 2015

(54) PACKAGE, CARTON AND BLANK THEREFOR

(75) Inventor: Jean Michel Auclair, Chateauroux (FR)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 12/812,838

(22) PCT Filed: Jan. 16, 2009

(86) PCT No.: PCT/US2009/031238
§ 371 (c)(1),
(2), (4) Date: Dec. 21, 2010

(87) PCT Pub. No.: WO2009/091969
PCT Pub. Date: Jul. 23, 2009

(65) Prior Publication Data

US 2011/0100871 A1 May 5, 2011

(30) Foreign Application Priority Data

Jan. 16, 2008 (GB) ..... 0800750.2

(51) Int. Cl.
*B65D 23/12* (2006.01)
*B65D 71/22* (2006.01)

(52) U.S. Cl.
CPC ..... *B65D 71/22* (2013.01); *B65D 2571/0066* (2013.01); *B65D 2571/00141* (2013.01); *B65D 2571/00277* (2013.01);
(Continued)

(58) Field of Classification Search
CPC ..... B65D 5/528; B65D 2571/0066
USPC ..... 206/434, 773, 148, 194, 158, 152, 197, 206/779, 772, 783, 435, 782, 775, 429, 780, 206/427, 459.5, 730, 731, 732, 733, 734, 206/735; 229/122, 120.18, 120.17, 120.22, 229/120.04, 120.14, 120.15, 188, 162.1, 229/162.3, 162.5, 162.6, 103.2
See application file for complete search history.

(56) References Cited

U.S. PATENT DOCUMENTS 2,182,065 A * 12/1939 Warren ..... 206/142
2,200,813 A * 5/1940 Warren ..... 206/143
2,522,950 A 9/1950 Keith
(Continued)

FOREIGN PATENT DOCUMENTS

EP 0340920 A 11/1989
EP 1533246 A 5/2005
(Continued)

*Primary Examiner* — Jacob K Ackun
*Assistant Examiner* — Jenine Pagan
(74) *Attorney, Agent, or Firm* — WestRock Intellectual Property Group

(57) ABSTRACT

A carton for containing one or more articles, the carton comprising a series of walls for retaining said one or more articles within 5 the carton, wherein a presentation and retention means is incorporated within one of said walls. The presentation and retention means comprises a displaceable tab (62, 68) connected to the wall (24) in which the presentation and retention means is incorporated such that once displaced to create a window for displaying an article the displaceable tab is biased to return to its original position and 10 thereby retains the displayed article within the carton. Optionally, the biasing is achieved by virtue of the connection of the displaceable tab being about a non-linear hinge line. Additionally, or alternatively, this biasing is achieved by the displaceable tab being connected a hinge line (60*b*, 60) co-extensive with the extent of the displaceable tab.

20 Claims, 3 Drawing Sheets

(52) U.S. Cl.
CPC ..... *B65D 2571/00308* (2013.01); *B65D 2571/00716* (2013.01); *B65D 2571/00845* (2013.01)

(56) References Cited

U.S. PATENT DOCUMENTS

| | | | | | |
|---|---|---|---|---|---|
| 2,563,065 | A | | 8/1951 | Price | |
| 2,867,320 | A | | 1/1959 | Andre | |
| 2,881,914 | A | * | 4/1959 | Woeber et al. | 206/434 |
| 2,889,957 | A | * | 6/1959 | Kilmartin | 206/167 |
| 2,946,436 | A | * | 7/1960 | Williamson | 206/141 |
| 3,027,996 | A | * | 4/1962 | Transport | 206/779 |
| 3,163,321 | A | * | 12/1964 | Weiss | 206/196 |
| 3,278,075 | A | * | 10/1966 | Weiss | 206/158 |
| 3,337,033 | A | * | 8/1967 | Cote | 206/418 |
| 3,424,299 | A | * | 1/1969 | Rosenburg, Jr. | 206/763 |
| 3,741,380 | A | * | 6/1973 | Carney | 206/783 |
| 3,780,906 | A | | 12/1973 | Katzenmeyer | |
| 4,373,630 | A | * | 2/1983 | Oliff | 206/434 |
| 4,421,232 | A | * | 12/1983 | Konaka | 206/434 |
| 4,533,047 | A | | 8/1985 | Calvert | |
| 4,570,787 | A | | 2/1986 | Forbes | |
| 5,595,299 | A | | 1/1997 | LeBras | |
| 6,527,108 | B1 | * | 3/2003 | Blin et al. | 206/148 |
| 6,619,483 | B1 | * | 9/2003 | Paine | 206/784 |
| 2006/0091193 | A1 | | 5/2006 | DeBusk | |

FOREIGN PATENT DOCUMENTS

| | | | |
|---|---|---|---|
| GB | 2124592 | A | 2/1984 |
| WO | 9603328 | A1 | 2/1996 |
| WO | 9858853 | A1 | 12/1998 |
| WO | 0234639 | A1 | 5/2002 |

* cited by examiner

PACKAGE, CARTON AND BLANK THEREFOR

FIELD OF THE INVENTION

The invention relates to a carton having a presentation and retention window a blank for forming the carton and a package comprising the carton and one or more articles.

BACKGROUND OF THE INVENTION

In the field of packaging it is often required to provide consumers with a grouped array of articles sold for convenience as a multipack. This is desirable for the consumer who can easily select and carry a number of similar items and often purchasing multi-packs is more economical than purchasing a similar number of individual items. However such multipacks must be provided with means for securely retaining the articles because failure of the package can cause damage and spoiling of the goods inside.

It is known to inscribe packaging made of suitable material with advertising graphics and promotional material relating to the products they contain. It is advantageous in the field of advertising and marketing to promote goods with branding and decoration appealing to consumers.

The present invention provides a new package with desirable benefits compared to known packages, in which a presentation and retention means comprises a displaceable tab connected to a wall in which the presentation and retention means is incorporated in such a way that once displaced to create a window for displaying an article the displaceable tab is biased to return to its original position and thereby retains the displayed article within the carton.

SUMMARY OF INVENTION

According to a first aspect, the invention provides a carton for containing one or more articles, the carton comprising a series of walls for retaining said one or more articles within the carton, wherein a presentation and retention means is incorporated within one of said walls, said presentation and retention means comprising a displaceable tab formed from and connected to the one wall in which the presentation and retention means is incorporated about a connection structured and arranged such that once displaced from an original position in which the displaceable tab lies in a plane of the one wall, a window is created in the one wall to display an article in the window and the displaceable tab is biased to return to the original position to retain the displayed article within the carton.

Preferably, said connection is formed by non-linear hinge line. Optionally, the non-linear hinge line is arcuate or curved in shape.

Additionally or alternatively, the displaceable tab is connected to the wall in which the presentation and retention means is incorporated about a hinge line co-extensive with the extent of the displaceable tab Preferably, the connection of the displaceable tab is shaped and arranged such that once displaced, the displaceable tab provides a frame around at least a portion of the displayed article.

Optionally, the structural wall in which the presentation and retention means is incorporated provides a side wall of the carton and said connection extends between a top edge and a bottom edge of that side wall.

Preferably, the presentation and retention means comprises two displaceable tabs disposed in mirrored positions such that a retaining force is imparted onto opposite sides of a displayed article. Additionally, said two displaceable tabs provide a symmetrical frame around said displayed article.

Optionally a free edge of each of the two displaceable tabs is defined by a common cut line.

Optionally, the presentation and retention window comprises two displaceable tabs disposed back to back between two adjacent articles such that when displaced, one of said displaceable tabs provides a retaining frame around part of one of the adjacent articles and the other of said displaceable tabs provides a retaining frame around part of the other of the adjacent articles.

Preferably the non-linear hinge line is defined by a series of folded portions interrupted by a series of half-depth cut portions.

According to a third aspect, the invention provides a blank for forming a carton in accordance with the preceding paragraphs.

BRIEF DESCRIPTION OF THE DRAWINGS

An exemplary embodiment of the invention will now be described with reference to the accompanying drawings, in which.

DETAILED DESCRIPTION OF PREFERRED EMBODIMENT

Figure 1:
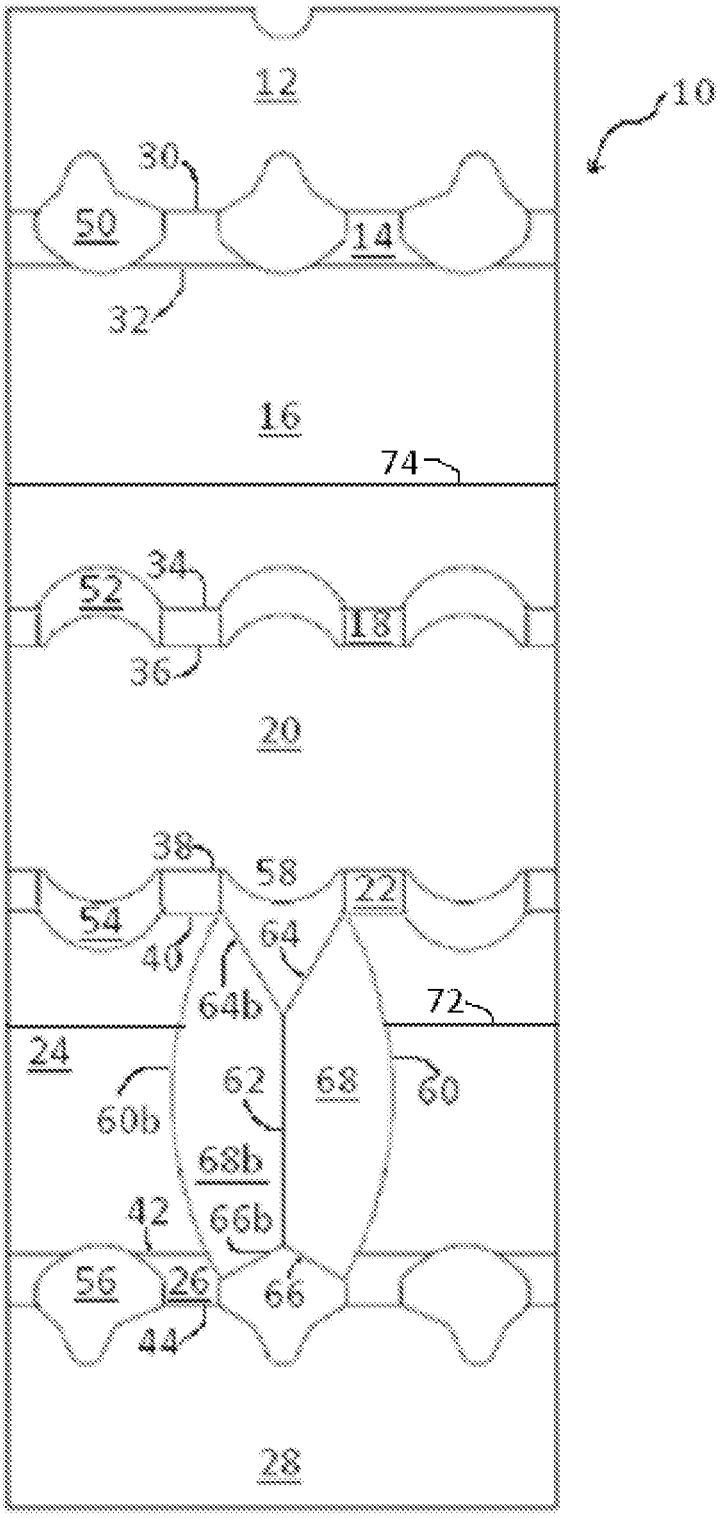
FIG. 1 shows a plan view of a blank for forming a carton according to a first embodiment of the invention.
Figure 2:
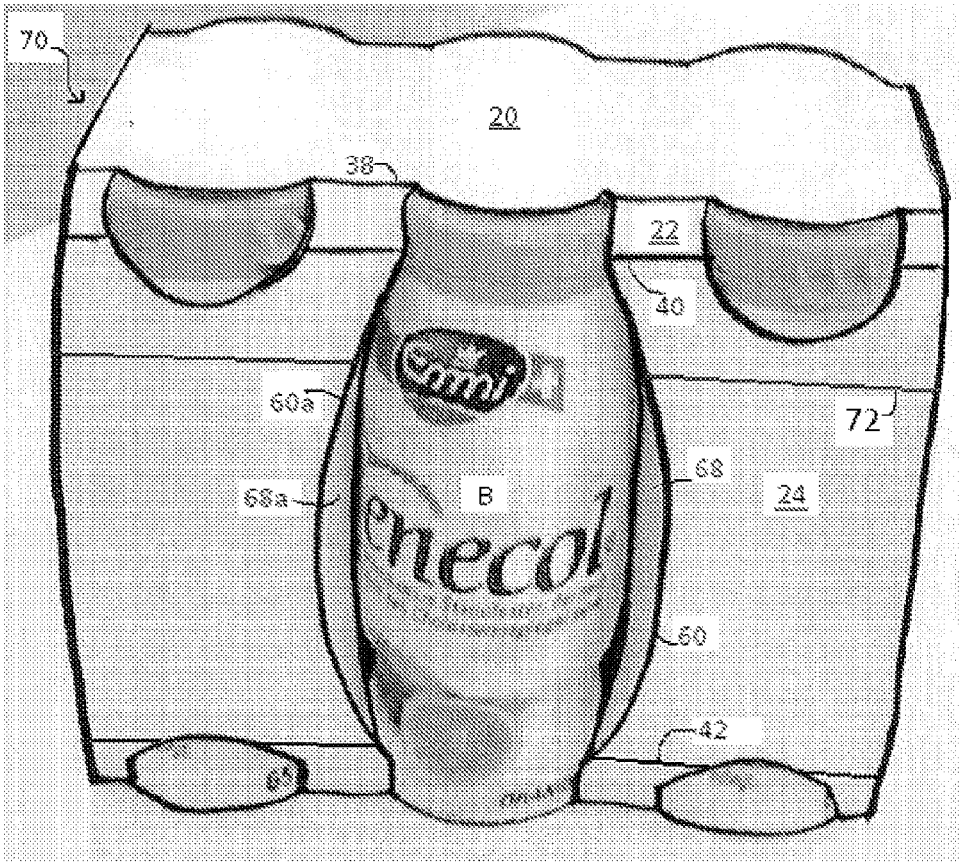
FIG. 2 shows a package formed from the carton formed from the blank of FIG. 1 loaded with articles.

The invention relates to a presentation and retention window formed within a structural wall of a carton. FIGS. 1 and 2 illustrate an exemplary application of the invention to a paperboard blank for forming a carton known as a wraparound carrier. Wraparound carriers of the type depicted are wrapped around a collated group of articles and secured usually at the top or bottom of the carrier, thus forming a package. It should be understood that the invention is applicable to a wide range of types of carton and may be formed from any suitable foldable sheet material.

Turning specifically to FIG. 1, there is shown a blank 10 comprising a series of main panels for forming the structural walls of the carton 70 depicted in FIG. 2. The main panels include a first bottom panel 28, first side panel 24, top panel 20, second side panel 16 and second bottom panel 12. The main panels are hinged together along fold lines 30, 36, 38 and 42. The main panels are interrupted by optional fold lines 32, 34, 40, & 44 forming bevel portions 14, 18, 22 and 26.

The blank shown is prepared for holding six articles (B) disposed in two rows of three articles (A) each. As such, three similar heel apertures 56, 50 are provided in each of the first and second bottom panels respectively. Likewise, three similar top apertures 52, 54 are provided on either side of the top panel 20. It is known in the art to provide such heel and top apertures 56, 50, 52, 54 in order to enable the articles (A) to be securely received within and retained by the carrier 70.

The fold lines 32, 34, 40, & 44 are provided in the vicinity of the heel and top apertures 50, 52, 54 and 56 respectively. The bevel portions 14, 18, 22 and 26 are provided to enable the blank 10 as it is wrapped around a group of articles (A) to closely follow the contour of the articles, specifically around the article necks and heels. This feature is optional and it is envisaged in other embodiments these fold lines 30, 32, 34, 36, 38, 40, 42, 44 and/or bevelled panels will not be included. In this embodiment additional optional horizontal fold lines 72, 74 are provided to encourage the wrap around carton 70 to follow the contour of the shoulder portion of the contained articles. These lines are optional and may be omitted or may be differently positioned according to the shape and dimension of a contained article. In the present embodiment the optional fold lines 32, 34, 40, 42 create a carton 70 having a hexagonal cross-sectional shape. This shape, particularly in relation to the first side wall 24 and upper and lower bevelled panels 22, 26 can assist in the creation of tension when the displaceable tab 68, 68*b* is folded inwardly of the plane of the first side wall 24. It is envisaged that in other embodiments only the cross-sectional shape of structural wall in which the presentation and retention means is formed is shaped to enhance the tension created when the displaceable tab 68, 68*b* is folded inwardly.

The presentation and retention window of the present invention is incorporated within one of the structural walls, in this case first side wall 24 and comprises a displaceable tab or flap 68. The displaceable tab 68 is defined in this embodiment by a curved i.e. non-linear, non-straight hinge connection 60 and cut lines 64, 62, 66. A similar displaceable tab 68*b* is shown in a mirrored position opposite to displaceable tab 68. The displaceable tab 68*b* is defined by a curved i.e. non-linear, non-straight hinge connection 60*b* and cut lines 64, 62, 66. The use of two displaceable tabs 68, 68*b*, is optional.

The non-linear hinge line is shaped such that once the tab 68, 68*b* is displaced to display an article (A) as shown in FIG. 2, the displaceable tab 68, 68*b* has a natural tendency to return to its original, not-folded, planar position. Thereby the biased displaced tab 68, 68*b* imparts a retaining force to retain the displayed article (A) within the carton (70). During the construction of the carton 70, the displaceable tab 68, 68*a* is folded inwardly of first side panel 24. The non-linear nature of the hinge line causes a state of tension to be created, especially as rigid articles (A), such as bottles, brace between the top 20 and composite bottom wall formed by first and second bottom panels 28, 12. The biased tab 68, 68*b* provides for the secure retention of the displayed article. The hinge line can be any shape that creates such biasing to retain the displayed article and optionally is not a perfect arc or smooth curve (though such a shape for presentation purposes is preferred). Optionally the connection of the displaceable tab 68, 68*b* to the first side wall 24 is formed by two angle straight lines forming a shallow "<" shape. Preferably the hinge line extends between a top edge of the structural wall in which the presentation and retention window is incorporated and a bottom edge of that panel, in this embodiment between fold lines 40 and 42. Preferably, the displaceable tab 68, 68*b* is connected to the first side wall 24 about a hinge connection that is co-extensive with the extent of the displaceable tab. Such a continuous connection assists in biasing the tab to return to its natural unfolded position.

Turning to the construction of a carton 70 from the blank 10 as illustrated in FIG. 2, the top panel 20 is placed upon an arranged group or articles (A). Displaceable 68, 68*b* are folded inwardly of the first side wall panel 24 about hinge line 60, 60*a* by mechanical means. First and second side walls 24, 16 are folded about fold lines 36, 38 into a substantially parallel relationship alongside a row of articles (A). As the open presentation window mates with an article (A), this article (A) protrudes into the presentation window. As the mechanical means releases the displaceable tabs 68, 68*b*, the tabs have a tendency to revert to their unfolded position and push against the displayed article thereby closing in the opening created and securely retaining the displayed article. The displaced tab provides a frame or edge around the displayed article, thus highlighting or emphasizing the product containing within the carton and presenting. First and second bottom panels 28, 12 are folded beneath the grouped articles (a) and secured together to form a composite bottom wall and thus securing the articles within the carrier 70.

It is envisaged that the carton 70 can be formed by a series of sequential folding operations in a straight line machine so that the carton is not required to be rotated or inverted to complete its construction. The folding process is not limited to that described above and may be altered according to particular manufacturing requirements.

Figure 3:
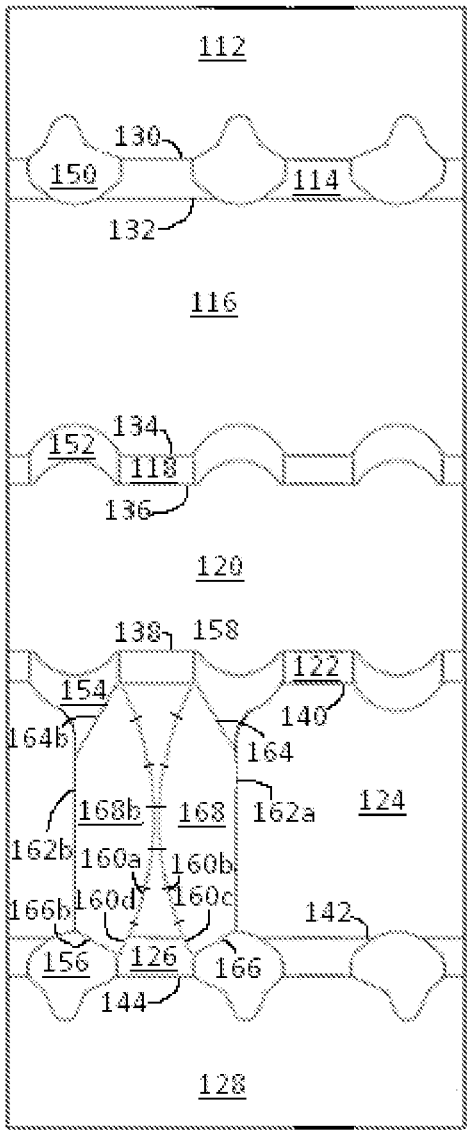
FIG. 3 shows a plan view of a blank for forming a carton according to a second embodiment of the invention.

It can be appreciated that various changes may be made within the scope of the present invention, for example, the display and retaining window comprises only one tab in some embodiments. In other embodiments, the size and shape of the displaceable tab and presentation window created is adjusted to accommodate articles of differing size or shape. In other embodiments of the invention it is envisaged that two displaceable tabs are provided back to back and each frames, retains and allows to be displayed a different article. Such an embodiment is illustrated by FIG. 3, wherein a plan view of a blank for forming a carton according to a second embodiment of the invention is illustrated. In FIG. 3, reference numerals similar to those used in FIG. 1 have been used to denote like features, albeit the reference numerals have been raised by a factor '100' in order to highlight that they are features of the second embodiment. The back-to-back displaceable tabs are denoted by reference numeral 168 and 168*b* respectively. Each displaceable tab 168, 168*b* is defined by cut lines 162*a*, 162*b*, 164, 164*b* and 166, 166*b* and an arcuate hinged connection. Optionally, the arcuate hinge connection is defined by a series of folds 160*a*/160*b* interrupted by a series of half-depth cut lines 160*c*/160*d*. By incorporating an increased weakening of the paperboard material along the arcuate hinge connection, the displaceable tabs 168, 168*b* are more easily foldable. In both the first and second embodiments, the first side wall 24, 124 in which the display and retention window is formed may be caused to curve or bend convexly, as viewed from outside of the carton due to the inward folding of the displaceable tab 68, 168/168*b*.

In other embodiments more than one presentation and retention window is formed. Alternatively, the presentation and retention window may be formed from two displaceable tabs positioned on the same side of the carton and/or the displaceable tab may have a shaped edge to accommodate a particular shape of article and/or to provide a particular shape of display window.

It will be recognised that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a series of short slits, a frangible line, a fold line or a fold line interrupted by a series of substantially half depth cuts (meaning incisions made into the thickness of the paperboard) without departing from the scope of the invention.

The invention claimed is:

1. A package comprising:

a plurality of articles;

a series of carton walls forming a carton for receiving the articles, the series of carton walls comprising a top panel disposed on top of the articles, a bottom panel disposed under the articles, a first side panel connected to the top panel, and a second side panel disposed in a substantially parallel relationship with the first side panel; and a presentation and retention arrangement that is incorporated at least in the first side panel, the presentation and retention arrangement comprising first and second displaceable tabs formed from part of the first side panel, the first and second displaceable tabs being connected to the first side panel along first and second hinged connections respectively, the first and second displaceable tabs each having an original position in which the first and second displaceable tabs lie in a plane of the first side panel, and a displaced position in which the first and second displaceable tabs are folded inwardly into the carton to define a window in the first side panel to display one of the articles in the window, the first displaceable tab, when in the displaced position, being positioned between the one of the articles and another one of the articles and being biased toward the original position to retain the one of the articles in the window, wherein the first and second hinged connections are shaped and arranged such that when in the displaced position, the first and second displaceable tabs are visible through the window as viewed from an outside of the carton while the first displaceable tab retains the articles in the window and wherein the first side panel is caused to curve convexly as viewed from the outside of the carton when the first and second displaceable tabs are in the displaced position.

2. The package according to claim 1 wherein the first and second hinged connections each is formed by a non-linear hinge line.

3. The package according to claim 2 wherein the non-linear hinge line is curved in shape.

4. The package according to claim 2 wherein the window extends between the top and bottom panels such that most of one side of the one of the articles is visible through the window.

5. The package according to claim 1 wherein the first side panel is connected to the top panel along a first fold line.

6. The package according to claim 5 wherein the first fold line is a single fold line divided into two or more aligned fold line segments.

7. The package according to claim 5 wherein the second side panel is connected to the top panel along a second fold line, the first and second fold lines being substantially parallel.

8. The package according to claim 1 wherein the second displaceable tab, when in the displaced position, is positioned between the one of the articles and another one of the articles.

9. A package comprising a plurality of articles and a carton in which the articles are received, the carton comprising:

a series of carton walls forming the carton in which the articles are retained, the carton walls including a top wall, a bottom wall and a pair of first and second side walls each extending between the top and bottom walls, the top wall being disposed on top of the articles and the bottom wall being disposed under the articles, the first side wall being directly connected to the top wall along a single fold line; and a presentation and retention arrangement that is incorporated at least in the first side wall, the presentation and retention arrangement comprising at least one displaceable tab formed from part of the first side walls, the at least one displaceable tab being connected to the first side wall along a non-linear hinge line and folded into the carton to be disposed alongside one of the articles, the at least one displaceable tab having an original position in which the at least one displaceable tab lies in a plane of the first side wall and a displaced position in which the at least one displaceable tab is folded into the carton to define a window at least in the first side wall to display the one of the articles in the window, wherein the non-linear hinge line is shaped and arranged such that when in the displaced position, the at least one displaceable tab is pressed against the one of the articles and is visible through the window as viewed from an outside of the carton while the at least one displaceable tab retains the one of the articles in the window, and wherein the first side wall curves convexly as viewed from the outside of the carton when the at least one displaceable tab is in the displaced position.

10. The package according to claim 9 wherein the non-linear hinge line is arcuate in shape.

11. The package according to claim 9 wherein the window extends between the top and bottom walls such that most of one side of the one of the articles is visible through the window.

12. The package according to claim 9 wherein the articles comprise at least first, second and third articles in a row, the at least one of the articles being the second article, the at least one displaceable tab includes first and second displaceable tabs which are disposed in mirrored positions such that when in the displaced position, the first displaceable tab is disposed between the first and second articles and the second displaceable tab being disposed between the second and third articles.

13. The package according to claim 9 wherein the articles include two adjacent articles, the at least one displaceable tab includes two displaceable tabs disposed back to back between the two adjacent articles such that when displaced, one of the displaceable tabs retains one of the two adjacent articles and the other of the two displaceable tabs retains the other of the two adjacent articles.

14. The package according to claim 9 wherein the first side wall includes a lower bevel portion hingedly connected to a respective one of opposed side edges of the bottom wall, the lower bevel portion of the first side wall being hingedly connected to the remainder of the first side wall along a fold line, and wherein the window extends from the lower bevel portion of the first side wall into the remainder of the first side wall.

15. The package according to claim 14 wherein the at least one displaceable tab is connected to the lower bevel portion of the first side wall along a lower part of the non-linear hinge line.

16. A package comprising:

a carton comprising a top panel, a first side panel connected to the top panel and a second side panel disposed in a substantially parallel relationship with the first side panel; and a plurality of articles received in the carton, the plurality of articles including first and second articles disposed in a row, wherein the first side panel comprises only two displaceable tabs connected to the first side panel by two hinged connections respectively, the two displaceable tabs are folded about the hinged connections to a displaced position inside the carton such that the two displaceable tabs together defines in the first side panel a single window through which only the first article is exposed to view, one of the two displaceable tabs when in the displaced position being positioned between the first and second articles, the first side panel including a portion disposed alongside the second article, and wherein the first side panel is caused to curve convexly as viewed from an outside of the carton when the two displaceable tabs are in the displaced position.

17. The package according to claim 16 wherein the plurality of articles further include a third article, the plurality of articles being arranged such that the first article is positioned between the second and third articles, the other of the two displaceable tabs when in the displaced position being positioned between the first and third articles, the first side panel including a portion disposed alongside the third article.

18. The package according to claim 17 wherein when retaining the first article in the window, the two displaceable tabs are exposed to view through the window.

19. The package according to claim 16 wherein the hinged connections are shaped such that the two displaceable tabs, when in the displaced position, are biased toward the first article to retain the first article in the window.

20. The package according to claim 16 wherein the two hinged connections each is formed by a non-linear hinge line.

* * * * *